US008185973B2

(12) United States Patent
Barjot

(10) Patent No.: US 8,185,973 B2
(45) Date of Patent: May 29, 2012

(54) SERIES OF UNDERWATER VISION ARTICLES

(75) Inventor: Nicolas Barjot, Moosch (FR)

(73) Assignee: Decathlon, Villeneuve d'Ascq (FR)

( * ) Notice: Subject to any disclaimer, the term of this patent is extended or adjusted under 35 U.S.C. 154(b) by 867 days.

(21) Appl. No.: 12/089,634

(22) PCT Filed: Oct. 10, 2006

(86) PCT No.: PCT/FR2006/051010

§ 371 (c)(1),
(2), (4) Date: Aug. 14, 2008

(87) PCT Pub. No.: WO2007/042725

PCT Pub. Date: Apr. 19, 2007

(65) Prior Publication Data

US 2009/0056001 A1 Mar. 5, 2009

(30) Foreign Application Priority Data

Oct. 10, 2005 (FR) ..... 05 10333

(51) Int. Cl.
*A61F 9/02* (2006.01)

(52) U.S. Cl. ..... 2/440

(58) Field of Classification Search ..... 2/427, 428, 2/440

See application file for complete search history.

(56) References Cited

U.S. PATENT DOCUMENTS

| | | | | |
|---|---|---|---|---|
| 6,880,177 | B2 * | 4/2005 | Sung | 2/440 |
| 2005/0193479 | A1 | 9/2005 | Atta et al. | |
| 2009/0125281 | A1 * | 5/2009 | Barjot et al. | 703/1 |

FOREIGN PATENT DOCUMENTS

| | | |
|---|---|---|
| FR | 2 707 120 | 1/1995 |
| FR | 2 843 684 | 2/2004 |
| FR | 2 857 272 | 1/2005 |
| WO | 95/35133 | 12/1995 |
| WO | 2007/017592 | 2/2007 |

OTHER PUBLICATIONS

International Search Report: PCT/FR2006/051010, Oct. 10, 2006.

* cited by examiner

*Primary Examiner* — Katherine Moran
(74) *Attorney, Agent, or Firm* — Ladas & Parry LLP

(57) ABSTRACT

The invention concerns a series of underwater vision articles comprising two optical elements (1, 3), two sealing elements placed in contact with the face via their right and left contact areas (2, 4), having the following characteristics: the optical elements are placed flatly on a plane on the side opposite the contact areas: P1, P2 represent respective points that are the lowest and to the furthest left from the inner edge (5) or outer edge (6) of the left contact area (4); P3, P4 represent respective points that are the lowest and the furthest right from the inner edge (7) or outer edge (8) of the right contact area (2). Independent of the size, the ratio between $PP_{2,4}$ and $PP_{1,3}$ is constant, and/or the ratio between, on the one hand, $PP_{2,4}$ and a constant and, on the other, $PP_{1,2}$ is constant or $PP_{i,j}$ is the distance between $P_i$ and $P_j$ for any i and j.

10 Claims, 2 Drawing Sheets

Figure 1:
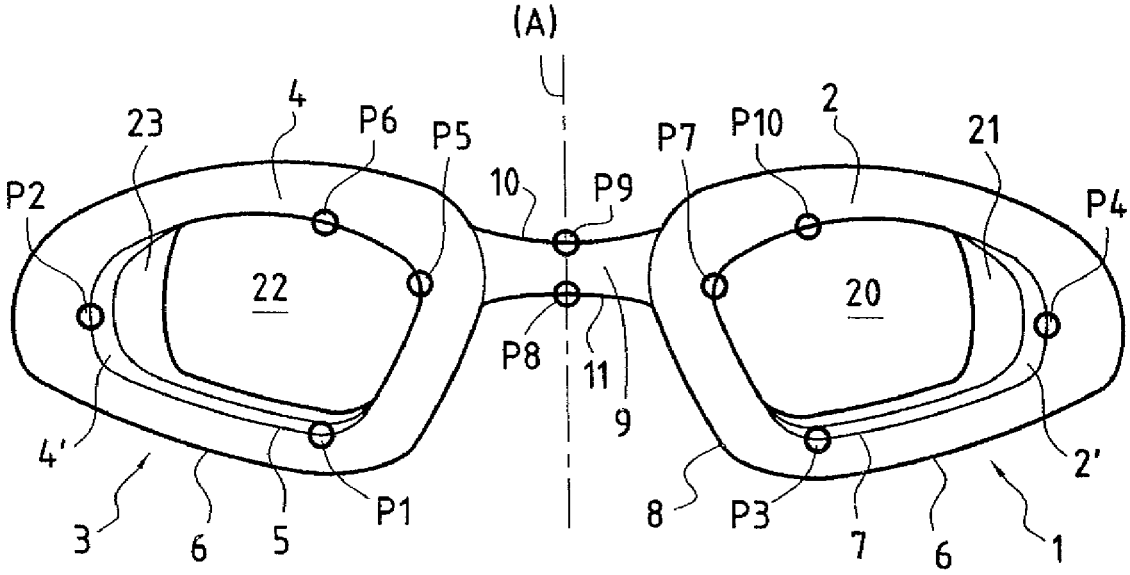

12
(A)
P10
P5
5
14
P6
10
7
23
21
9
4'
2'
22
20
P9
P8
11
P2
P4
P7
4
13
2
3
6
P1
P3
8
1

(A)
P11
P6
12
P14
17
16
P10
4
2
P2
P9
P4
23
22
20
21
P5
15
P7
P8
5
19
7
6
8
P12
18
P13
3
P1
P3
1

SERIES OF UNDERWATER VISION ARTICLES

The object of the present invention is a series of underwater vision articles. In particular it finds application in the field of articles such as swimming goggles, swimming or diving masks.

Generally, a product is proposed for sale in a single size or in several sizes.

When it is proposed in a single size, it is obviously understood that the product will not be necessarily adapted to any user. Indeed, the size, whichever its definition, will generally be statistically determined for adaptation to the largest number of them. But the satisfaction rate, related to the adaptation rate, will be relatively small, taking into account the various possible morphotypes, and the morphological differences within a same morphotype.

The problem is particularly delicate for products such as underwater vision articles, such as swimming goggles, swimming or diving masks. For such products, the question of comfort and seal is posed primordially. Indeed, it is extremely difficult to design a product in a single size which provides a satisfactory comfort level and a degree of waterproofness for a large number of persons, because the morphological differences in the face may be significant from one person to the other.

In such a situation, in order to increase comfort, it is possible for example to add to the product a foam joint which will better conform to the face of the user in order to compensate maladjustment of the single size. But the problem will then be the low degree of waterproofness due to the type of joint.

Conversely, in order to guarantee a good seal, a silicone gasket may be added to the product, the former providing a higher degree of waterproofness than the one provided by a foam gasket. But the problem will then be the discomfort for a certain number of users for which the single size is not adapted.

Often underwater vision articles are found proposed in two sizes, one for children and one for adults, which will notably allow the taking into account of the variation of the width of the face. But this single distinction between two categories of morphotypes (children and adults) is not always sufficient to make the product suitable for a maximum number of users. Thus, the product will not be sufficiently adapted to a too large number of children, the morphotype of which does not correspond to the standardized one of the single children's size of the product. This of course is the same for the single adult size. In fact, the satisfaction rate, related to the adaptation rate, will remain low, always taking into account the different possible morphotypes, and morphological differences within a same morphotype.

It is therefore understood that a product proposed to users in several sizes would satisfy a larger number of them. Further, dimensional parameters of the products adapted to one or several morphotypes, related to each other through independent relationships of this morphotype, would provide characterization of a series of products with a high coverage rate.

The problem which is then posed is therefore of having a series of underwater vision articles with which a high morphotype coverage rate may be obtained, so as to be able to propose to each individual the size from a set of possible sizes, which is most suitable from a dimensional definition independent of this size.

The object of the invention is therefore to provide a solution to the aforementioned problems among other problems.

The applicant from anthropometric and statistical investigations thereby managed to define the characteristics of a series of underwater vision articles, in which, whatever actually is the size of the article, certain dimensional parameters of this article, indirectly corresponding to morphological parameters of the face of an individual, are related to at least one main dimensional parameter through an arithmetic relationship based on constant numerical coefficients regardless of the size of the article.

The invention therefore relates to a series of underwater vision articles comprising several articles of different sizes, these articles including a right optical element itself including a right sealing element intended to come into contact via its right contact area, with the face of a person, and a left optical element itself including a left sealing element intended to come into contact, via its left contact area, with the face of a person, these articles further including the following characteristic points, by considering the right and left optical elements placed down flat on a same supporting plane on their side opposite to the side of the right and left contact areas of the left and right sealing elements:

- $P_1$: the lowest point of the inner or outer edge of the left contact area,
- $P_2$: the leftmost point of the inner or outer edge of the left contact area,
- $P_3$: the lowest point of the inner or outer edge of the right contact area,
- $P_4$: the rightmost point of the inner or outer edge of the right contact area.

In a characteristic way, regardless of the size of the articles:

- the ratio between $PP_{2,4}$ and $PP_{1,3}$ is constant to within 5%, preferably to within 3%; and/or
- the ratio between $PP_{2,4}$ plus a constant predefined to within 5%, preferably within 3%, on the one hand, and $PP_{1,2}$ on the other hand, is constant to within 5%, preferably to within 3%, wherein $PP_{i,j}$ is the distance between $P_i$ and $P_j$, for any i and j.

Thus, with such a series of underwater vision articles it is possible to obtain a high morphotype coverage rate, so as to be able to propose to each individual, the size from a set of possible sizes, which is the most suitable for him/her, from a dimensional definition independent of this size, since there exists a constant relationship between at least one significant parameter and one main parameter, i.e. the parameter $PP_{2,4}$ which is directly related to the width of the face of the person intended to wear the article.

In a first alternative, the articles are swimming goggles, and the article series is characterized in that regardless of the size of said articles, the ratio between $PP_{2,4}$ and $PP_{1,3}$ is equal to 1.7428 to within 5%, preferably to within 3%, and/or the ratio between $PP_{2,4}$ and $PP_{1,2}$ is equal to 3.4722 to within 5%, preferably to within 3%.

In combination with the first object of the invention presented above, always in the case when the articles are swimming goggles, and possibly also in combination with the first alternative presented above, the series of articles may be characterized in the way presented hereafter.

The articles include in addition to the points $P_1$, $P_2$, $P_3$ and $P_4$, the following characteristic points:

- $P_5$: the rightmost point of the inner edge of the left contact area,
- $P_6$: the point at the intersection of the upper portion of the inner edge of the left contact area with the axis passing through the point $P_1$ and perpendicular to the segment $[P_2; P_4]$,
- $P_7$: the leftmost point of the inner edge of the right contact area, $P_8$: the point in the middle of the upper edge of the bridge connecting the right optical element to the left optical element, $P_9$: the point in the middle of the lower edge of the bridge.

The series is also characterized in that, regardless of the size of the articles one or more of the following relationships are verified:

$PP_{1,5}=a_{1,5}^{1,6}\times PP_{1,6}$, and/or $PP_{2,6}=a_{2,6}^{2,4}\times PP_{2,4}+b_{2,6}^{2,4}$, and/or $PP_{5,6}=a_{5,6}^{1,6}\times PP_{1,6},+b_{1,6}^{5,6}$ and/or $PP_{5,8}=a_{5,8}^{5,7}\times PP_{5,7}+b_{5,8}^{5,7}$, and/or $PP_{8,9}=b_{8,9}$, wherein $PP_{ij}$ is the distance between $P_i$ and $P_j$, for any i and j, and $a_{1,5}^{1,6}$, $a_{2,6}^{2,4}$, $b_{2,6}^{2,4}$, $a_{5,6}^{1,6}$, $b_{1,6}^{5,6}$, $a_{5,8}^{5,7}$, $b_{5,8}^{5,7}$ and $b_{8,9}$ are predefined real numbers constant to within 5%, preferably to within 3%, regardless of the size of the articles.

Then, preferably, the values of this (these) real number(s) may be the following: $a_{1,5}^{1,6}=0.8745$, and/or $a_{2,6}^{2,4}=0.2450$, and/or $b_{2,6}^{2,4}=4.2$, and/or $a_{5,6}^{1,6}=0.3088$, and/or $a_{1,6}^{5,6}=15.7$, and/or $a_{5,8}^{5,7}=0.38741$ and/or $b_{5,8}^{5,7}=15.3$, and/or $b_{8,9}=10$, regardless of the size of the articles, these values being defined to within 5%, preferably to within 3%.

In all the present description, the distances $PP_{ij}$ are expressed in millimeters. Thus, the values given in this description for the coefficients $b_{i,j}^{k,l}$ in the relationships of the type $PP_{ij}=a_{ij}^{k,l}\times PP_{k,l}+b_{i,j}^{k,l}$ are valid for distances exclusively measured in millimeters. As for the values given in this description for the coefficients $b_{i,j}^{k,l}$ in the relationships of the above type, they are of course independent of the measurement unit used for the distances.

In a second alternative, as the articles are swimming masks, the article series is characterized in that regardless of the size of said articles, the ratio between $PP_{2,4}$ and $PP_{1,3}$ is equal to 2.6860 to within 5%, preferably to within 3%, and/or the ratio between $PP_{2,4}$ less the constant 44.0 defined to within 5%, preferably to within 3%, on the one hand, and $PP_{1,2}$ on the other hand, is equal to 1.3723 to within 5%, preferably to within 3%.

Here again, the distances $PP_{ij}$ are expressed in millimeters, the constant value of −44.0 shown above is valid for distances exclusively measured in millimeters.

In combination with the first object of the invention presented above, always in the case when the articles are swimming masks, and also possibly in combination with the second alternative presented above, the series of articles may be characterized in the way presented hereafter.

The articles have an axis of symmetry between the right and left optics, and the right and left contact areas join on either side of this axis of symmetry in a median contact area, the right and left optical elements being connected through a bridge.

The articles include, in addition to the points $P_1$, $P_2$, $P_3$ and $P_4$, the following characteristic points:

$P_5$: the point at the intersection of the upper portion of the outer edge of the left contact area with the axis passing through the point $P_1$ and perpendicular to the segment $[P_2; P_4]$, $P_6$: the point at the intersection of the upper portion of the outer edge of the right contact area with the axis passing through the point $P_3$ and perpendicular to the segment $[P_2; P_4]$, $P_7$: the point at the intersection of the axis of symmetry with the lower outer edge of the median contact area, $P_8$: the point in the middle of the lower edge of the bridge, projected on the median contact area, $P_9$: the point in the middle of the upper edge of the bridge, projected on the median contact area, $P_{10}$: the point at the intersection of the axis of symmetry with the upper outer edge of the median contact area.

The series is then characterized in that, regardless of the size of the articles, one or several of the following relationships are verified:

$PP_{2,5}=a_{2,5}^{2,4}\times PP_{2,4}$, and/or $PP_{6,9}=a_{6,9}^{1,5}\times PP_{1,5}$, and/or $PP_{1,7}=a_{1,7}^{1,5}\times PP_{1,5}$, and/or $PP_{8,9}=a_{8,9}^{2,4}\times PP_{2,4}+b_{8,9}^{2,4}$, and/or $PP_{7,8}=a_{7,8}^{2,4}\times PP_{2,4}+b_{7,8}^{2,4}$, and/or $PP_{5,8}=a_{5,8}^{1,5}\times PP_{1,5}+b_{5,8}^{1,5}$, and/or $PP_{1,8}=a_{1,8}^{1,5}\times PP_{1,5}+b_{1,8}^{1,5}$ and/or $PP_{9,10}=a_{9,10}^{1,5}\times PP_{1,5}+b_{9,10}^{1,5}$, wherein $PP_{ij}$ is the distance between $P_i$ and $P_j$, for any i and j and $a_{2,5}^{2,4}$, $a_{6,9}^{1,5}$, $a_{1,7}^{1,5}$, $a_{8,9}^{2,4}$, $b_{8,9}^{2,4}$, $a_{7,8}^{2,4}$, $b_{7,8}^{2,4}$, $a_{5,8}^{1,5}$, $b_{5,8}^{1,5}$, $a_{1,8}^{1,5}$, $b_{1,8}^{1,5}$, $a_{9,10}^{1,5}$ and $b_{9,10}^{1,5}$ are predefined real numbers constant to within 5%, preferably with 3%, regardless of the size of said articles.

Then, preferably, the values of this (these) real number(s) may be the following: $a_{2,5}^{2,4}=0.4365$, and/or $a_{6,9}^{1,5}=0.4938$, and/or $a_{1,7}^{1,5}=0.5777$, and/or $a_{8,9}^{2,4}=0.2000$, and/or $b_{8,9}^{2,4}=-10$, and/or $a_{7,8}^{2,4}=0.1333$, and/or $b_{7,8}^{2,4}=5.9$ and/or $a_{5,8}^{1,5}=0.3792$, and/or $b_{5,8}^{1,5}=16.5$, and/or $a_{1,8}^{1,5}=0.7050$, and/or $b_{1,8}^{1,5}=-1$, and/or $a_{9,10}^{1,5}=0.4073$, and/or $b_{9,10}^{1,5}=-8.2$, regardless of the size of the articles, these values being defined to within 5%, preferably to within 3%.

Finally, in a third alternative, as the articles are diving masks, the article series is characterized in that regardless of the size of said articles, the ratio between $PP_{2,4}$ and $PP_{1,3}$ is equal to 1.7562 to within 5%, preferably to within 3%, and/or the ratio between $PP_{2,4}$ and $PP_{1,2}$ is equal to 1.6861 to within 5%, preferably to within 3%.

In combination with the first object of the invention presented above, again in the case when the articles are diving masks, and also possibly in combination with the third alternative presented above, the series of articles may be characterized in the way presented hereafter.

The articles have an axis of symmetry between the right and left optics, and the right and left contact areas join on either side of this axis of symmetry in a median contact area, this median contact area having an imprint for the nose.

The articles include, in addition to the points $P_1$, $P_2$, $P_3$ and $P_4$, the following characteristic points:

$P_9$: the point at the intersection of the axis of symmetry with the top of the contour of the imprint for the nose, $P_5$: the point located on the left side of the contour of the imprint for the nose, at 4 cm from point $P_9$, $P_6$: the point at the intersection of the upper portion of the outer edge of the left contact area with the axis passing through the point $P_1$ and perpendicular to the segment $[P_2; P_4]$ $P_7$: the point located on the right side of the contour of the imprint for the nose, at 4 cm from point $P_9$, $P_8$: the deepest point of the imprint for the nose, $P_{10}$: the point at the intersection of the axis of symmetry with the inner edge of the upper portion of the median contact area, $P_{11}$: the point at the intersection of the axis of symmetry with the outer edge of the upper portion of the middle contact area, $P_{12}$: the point at the intersection of the axis of symmetry with the outer edge of the lower portion of the median contact area, $P_{13}$: the point at the intersection of the axis of symmetry with the inner edge of the lower portion of the median contact area.

The series is then characterized in that, regardless of the size of the articles, one or more of the following relationships are verified:

$PP_{2,9}=a_{2,9}^{2,4}\times PP_{2,4}$, and/or $PP_{1,13}=a_{1,13}^{5,7}\times PP_{5,7}$, and/or $PP_{5,9}=b_{5,9}$ and/or $PP_{8,9}=a_{8,9}^{1,6}\times PP_{1,6}$, and/or $PP_{9,13}=a_{9,13}^{1,6}\times PP_{1,6}$, and/or $PP_{8,13}=a_{8,13}^{1,6}\times PP_{1,6}+a_{8,13}^{2,4}\times PP_{2,4}+a_{8,13}^{5,7}\times PP_{5,7}+b_{8,13}$, and/or $PP_{12,13}=a_{12,13}^{1,6}\times PP_{1,6}+a_{12,13}^{2,4}\times PP_{2,4}+a_{12,13}^{5,7}\times PP_{5,7}+b_{12,13}$, and/or $PP_{9,12}=a_{9,12}^{1,6}\times PP_{1,6}+b_{9,12}^{1,6}$, and/or $PP_{1,9}=a_{1,9}^{1,6}\times PP_{1,6}+b_{11,13}^{1,6}$, and/or $PP_{6,9}=a_{8,9}^{2,4}\times PP_{2,4}+b_{6,9}^{2,4}$, and/or $PP_{11,13}=a_{11,13}^{1,6}\times PP_{1,6}+b_{11,13}^{1,6}$, and/or $PP_{10,13}=a_{10,13}^{1,6}\times PP_{1,6}+b_{10,13}^{1,6}$, wherein $PP_{i,j}$ is the distance between $P_i$ and $P_j$ for any i and j, and $a_{2,9}^{2,4}$, $a_{1,13}^{5,7}$, $b_{5,9}$, $a_{8,9}^{1,6}$, $a_{9,13}^{1,6}$, $a_{8,13}^{1,6}$, $a_{8,13}^{2,4}$, $a_{8,13}^{5,7}$, $b_{8,13}$, $a_{12,13}^{1,6}$, $a_{12,13}^{2,4}$, $a_{12,13}^{5,7}$, $b_{12,13}$, $a_{9,12}^{1,6}$, $b_{9,12}^{1,6}$, $a_{1,9}^{1,6}$, $b_{1,9}^{1,6}$, $a_{6,9}^{2,4}$, $b_{6,9}^{2,4}$, $a_{11,13}^{1,6}$, $b_{11,13}^{1,6}$, $a_{10,13}^{1,6}$ and $b_{10,13}^{1,6}$, are predefined real numbers constant to within 5%, preferably to within 3%, regardless of the size of the articles.

Then, preferably, the values of this or these real number(s) may be the following: $a_{2,9}^{2,4}=0.6926$, and/or $a_{1,13}^{5,7}=1.2085$, and/or $b_{5,9}=40$, and/or $a_{8,9}^{1,6}=0.5690$, and/or $a_{9,13}^{1,6}=0.5534$, and/or $a_{8,13}^{1,6}=0.1770$, and/or $a_{8,13}=0.2005$, and/or $a_{8,13}=-0.3168$, and/or $b_{8,13}=-4.6$, and/or $a_{12,13}^{1,5}=0.0487$, and/or $a_{12,13}^{2,4}=0.0552$, and/or $a_{12,13}^{5,7}=-0.0872$, and/or $b_{12,13}=-1.3$, and/or $a_{9,12}^{1067}=0.5796$, and/or $b_{9,12}^{1,6}=4.4$, and/or $a_{6,9}^{1,6}=0.5480$, and/or $b_{1,9}^{1,6}=24.6$, and/or $a_{6,9}^{2,4}=0.4813$, and/or $b_{6,9}^{2,4}=-1.5$, and/or $a_{11,13}^{1,6}=0.8781$, and/or $b_{11,13}^{1,6}=6.4$, and/or $a_{10,13}^{1,6}=0.7316$, and/or $b_{10,13}^{1,6}=10.3$, regardless of the size of the articles, these values being defined to within 5%, preferably to within 3%.

Other characteristics and advantages of the invention will become more clearly and completely apparent upon reading the description hereafter of preferred alternative embodiments, which are given as non-limiting examples and with reference to the following appended drawings.

Figure 2:
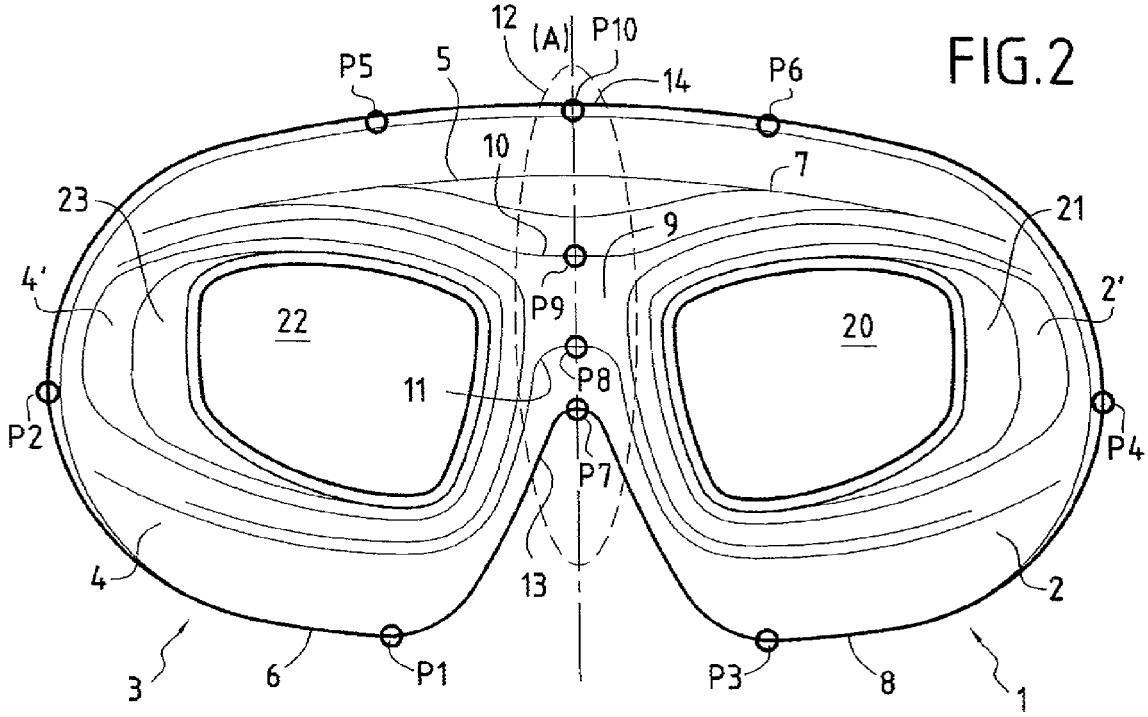
Figure 3:
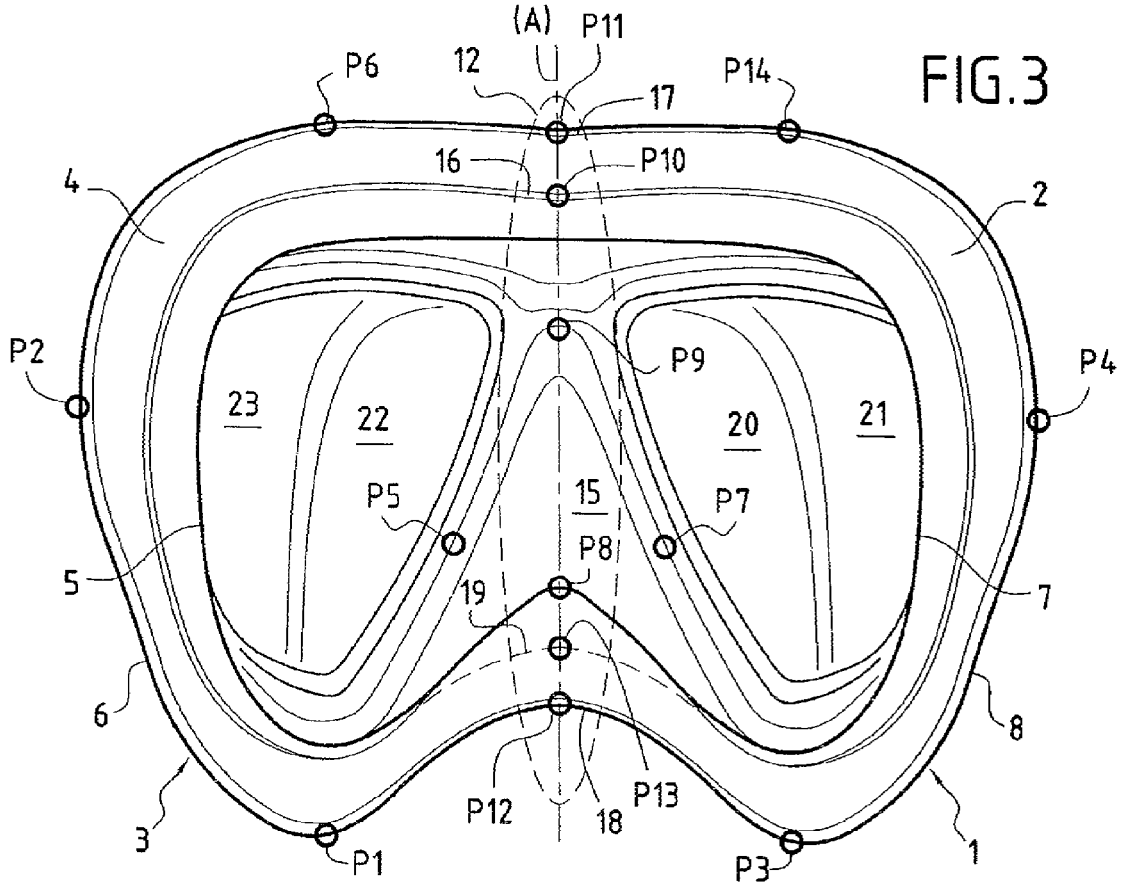

FIG. 1: schematically illustrates an article of the series of the invention in a first alternative, FIG. 2: schematically illustrates an article of the series of the invention in a second alternative, FIG. 3: schematically illustrates an article of the series of the invention in a third alternative, FIG. 1 therefore schematically illustrates an article of the series of the invention in a first alternative, wherein the article is more specifically of the swimming goggles type.

The article thus comprises two optical elements: a right optical element 1 and a left optical element 3. Each optical element comprises a sealing element and an actual optical portion, generally in translucent plastic material.

Thus, the right optical element 1 comprises an optical portion which may be broken down into a planar main element 20 and a side portion 21. The right optical element 1 also comprises, as mentioned above, a right sealing element, for example in silicone, which itself includes a contact area 2 via which this right sealing element will come into contact with the face of a person and possibly a side portion 2' via which this right sealing element joins the side optical portion 21.

In the same way, the left optical element 3 comprises an actual optical portion, generally in plastic material, which may be broken down into a planar main element 22 and a side portion 23. As mentioned above, the left optical element 3 also comprises a left sealing element, for example in silicone, which itself includes a left contact area 4 via which this left sealing element will come into contact with the face of a person and possibly a side portion 4' via which this left sealing element joins the side optical portion 23.

The right contact area of the optical element 1 comprises an inner edge 7 and an outer edge 8. Also, the left contact area 4 of the left sealing element of the left optical element 3 comprises an inner edge 5 and an outer edge 6.

The right optical element 1 and the left optical element 3 are possibly connected through a bridge 9, the upper edge of which is then referenced as 10 and the lower edge is referenced as 11.

The swimming goggles are thereby illustrated with their right and left optical elements 1 and 3, placed down flat on a same supporting plane on their optical portions 20 and 22, i.e. on their side opposite to the side of the right and left contact areas, 2 and 4, of the right and left sealing elements.

Moreover, the article has an axis of symmetry A passing through the respective middles of the lower 11 and upper 10 edges of the bridge 9.

These swimming goggles have the following characteristic points, the position of which is schematized in FIG. 1:

$P_1$: corresponds to the lowest point of the inner edge 5 of the left contact area 4, $P_2$: corresponds to the leftmost point of the inner edge 5 of the left contact area 4, $P_3$: corresponds to the lowest point of the inner edge 7 of the right contact area 2, $P_4$: corresponds to the rightmost point of the inner edge 7 of the right contact area 2.

The points $P_1$ and $P_3$ are therefore symmetrical with respect to the axis A, and the points $P_2$ and $P_4$ are therefore also symmetrical with respect to this axis A.

All the swimming goggles of the series, regardless of their sizes therefore of their dimensions, thereby have the aforementioned characteristic points.

The cutting-out of the series into several sizes and the accurate definition of these sizes derive from anthropological and statistical investigations and tests. They are thus defined in order to provide a maximum coverage rate of the population.

In this series, in a characteristic and fundamental way, certain dimensional parameters $PP_{i,j}$ which correspond to the distance between the characteristic points $P_i$ and $P_j$ are related to other dimensional parameters $PP_{i,j}$, by constant arithmetic relationships regardless of the size, i.e. arithmetic relationships independent of the size.

Thus, independently of the size, one or preferably both following relationships are verified:

$PP_{1,2}=a_{1,2}^{2,4}\times PP_{2,4}+b_{1,2}^{2,4}$ and/or $PP_{1,3}=a_{1,3}^{2,4}\times PP_{2,4}$, wherein $PP_{1,2}$ corresponds to the distance between the characteristic points $P_1$ and $P_2$, $PP_{1,3}$ corresponds to the distance between the characteristic points $P_1$ and $P_3$ and $PP_{2,4}$ corresponds to the difference between the characteristic points $P_2$ and $P_4$ (therefore a distance associated with the width of the face), and $a_{1,2}^{2,4}$, $a_{1,3}^{2,4}$, and $b_{1,2}^{2,4}$, are predefined real numbers constant to within a certain tolerance, regardless of the size of the articles (swimming goggles).

The investigations have shown that within a tolerance of 5%, preferably 3%, the series of swimming goggles retains its properties for maximum coverage of the different morphotypes of the targeted population. In other words, $a_{1,2}^{2,4}$, $a_{1,3}^{2,4}$, and $b_{1,2}^{2,4}$, are constant to within 5%, preferably to within 3%, regardless of the size of the articles.

Specifically, in this alternative described with reference to FIG. 1, regardless of the size of the swimming goggles, the values of the coefficients are the following, to within 5%, preferably to within 3%: $a_{1,2}^{2,4}=0.2880$, and/or $a_{1,3}^{2,4}=0.5738$, and/or $b_{1,2}^{2,4}=0$.

Preferably, but not necessarily, the three coefficients $a_{1,2}^{2,4}$, $a_{1,3}^{2,4}$ and $b_{1,2}^{2,4}$ are modified with the respective values above (within the tolerance of 5%, possibly 3%).

The swimming goggles may further be characterized with the following additional characteristic points:

$P_5$: corresponds to the rightmost point of the inner edge 5 of the left contact area 4, $P_6$: corresponds to the point at the intersection of the upper portion of the inner edge 5 of the left contact area 4 with the axis passing through the point $P_1$ and perpendicular to the segment $[P_2; P_4]$ $P_7$: corresponds to the leftmost point of the inner edge 7 of the right contact area 2, $P_8$: corresponds to the middle point of the upper edge 10 of the bridge 9 connecting the right optical element 1 to the left optical element 3, $P_9$: corresponds to the middle point of the lower edge 11 of the bridge 9.

The point $P_{10}$ illustrated in FIG. 1, symmetrical to the point $P_6$ with respect to the axis of symmetry A, is also characteristic of the swimming goggles, but however not useful for dimensional characterization of these goggles.

Then, in this series, certain additional dimensional parameters are related to other dimensional parameters, always by constant arithmetic relationships regardless of the size, i.e. arithmetic relationships independent of the size.

Thus, independently of the size, one or several of the following relationships, are verified:

$PP_{1,5}=a_{1,5}^{1,6}\times PP_{1,6}$, and/or $PP_{2,6}=a_{2,6}^{2,4}\times PP_{2,4}+b_{2,6}^{2,4}$, and/or $PP_{5,6}=a_{5,6}^{1,6}\times PP_{1,6}+b_{1,6}$, and/or $PP_{5,8}=a_{5,8}^{5,7}\times PP_{5,7}+b_{5,8}^{5,7}$, and/or $PP_{8,9}=b_{8,9}$.

In the same way as previously, the dimensional parameters $PP_{i,j}$ correspond to the distance between $P_i$ and $P_j$ for any i and j. Also, $a_{1,5}^{1,6}$, $a_{2,6}^{2,4}$, $b_{2,6}^{2,4}$, $a_{5,6}^{1,6}$, $b_{1,6}^{5,6}$, $a_{5,8}^{5,7}$, $b_{5,8}^{5,7}$, and $b_{8,9}$, are predefined real numbers, constant to within a certain tolerance, regardless of the size of the goggles.

As explained earlier, a tolerance of 5%, preferably 3%, gives a series of swimming goggles which retains its properties for maximum coverage of the different morphotypes of the targeted population. The aforementioned additional coefficients are therefore constant to within 5%, preferably to within 3%, regardless of the size of the articles.

Specifically, regardless of the size of the swimming goggles, the values of the additional coefficients are the following, to within 5%, preferably within 3%: $a_{1,5}^{1,6}=0.8745$, and/or $a_{2,6}^{2,4}=2450$, and/or $b_{2,6}^{2,4}=4.2$, and/or $a_{5,6}^{1,6}=0.3088$, and/or $b_{1,6}^{5,6}=15.7$, and/or $a_{5,8}^{5,7}=0.3874$, and/or $b_{5,8}^{5,7}=15.3$, and/or $b_{8,9}=10$.

Preferably, but not necessarily, all these additional coefficients, and not only some of them, are modified with the respective values above (within the tolerance of 5%, possibly 3%).

FIG. 2 schematically illustrates an article of a series of the invention in a second alternative. In this alternative, the article is more specifically of the swimming mask type.

The mask thus comprises two optical elements, as this is already the case for the swimming goggles described earlier: a right optical element 1 and a left optical element 3. Each optical element comprises a sealing element and an actual optical portion, generally in translucent plastic material.

In the same way as for the swimming goggles, the right optical element X comprises an optical portion, generally in plastic material, which may be broken down into a planar main element 20 and a side portion 21. The right optical element 1 also comprises as mentioned above, a right sealing element for example in silicone, which may assume the shape of a skirt, and which itself includes a contact area 2 via which this right sealing element will come into contact with the face of a person and possibly a side portion 2' via which this right sealing element joins the side optical portion 21.

Also, the left optical element 3 comprises an optical portion, strictly speaking, generally in plastic material, which may be broken down into a planar main element 22 and a side portion 23. The left optical element 3 also comprises a left sealing element, for example in silicone, possibly as a skirt, and which itself includes a left contact area 4 via which this left sealing element would come into contact with the face of a person and possibly a side portion 4' via which this left sealing element joins the side optical portion 23.

The right contact area of the optical element 1 comprises an inner edge 7 and an outer edge 8. Also, the left contact area 4 of the left sealing element of the left optical element 3, comprises an inner edge 5 and an outer edge 6.

The right optical element 1 and the left optical element 3 are symmetrical with respect to an axis of symmetry A.

In this alternative, the respective right and left contact areas 2, 4, join on either side of this axis of symmetry A in a median contact area 12.

The right optical element 1 and the left optical element 3 are then connected through a bridge 9 located in the median contact area 12, and the upper edge of which is referenced as 10 and the lower edge is referenced as 11. The axis of symmetry A specifically passes through the respective middles of the lower 11 and upper 10 edges of this bridge 9.

The median contact area 12 has a lower outer edge 13 and an upper outer edge 14.

The swimming mask is thereby illustrated with its right and left optical elements 1 and 3 placed down flat on a same supporting plane with their optical portions 20 and 22, i.e. on their sides opposite to the sides of the right and left contact areas 2 and 4, of the right and left sealing elements.

Moreover, the swimming mask has the same main characteristic points as those relevant to swimming goggles, the position of which is schematized in FIG. 2:

$P_1$: corresponds to the lowest point of the outer edge 6 of the left contact area 4, $P_2$: corresponds to the leftmost point of the outer edge 6 of the left contact area 4, $P_3$: corresponds to the lowest point of the outer edge 8 of the right contact area 2, $P_4$: corresponds to the rightmost point of the outer edge 8 of the right contact area 2.

In the same way as in the case of swimming goggles, point $P_1$ and $P_3$ are therefore symmetrical with respect to the axis A and points $P_2$ and $P_4$ are also symmetrical with respect to this axis A.

All the swimming masks of the series, regardless of their sizes, therefore of their dimensions, thereby have the characteristic points mentioned above.

As for the series of swimming goggles, the cutting out of the series into several sizes and the accurate definition of the sizes derive from anthropological and statistical investigations and tests and are defined so as to provide a maximum coverage rate of the population.

In this series, in a characteristic and fundamental way, and independently of the size, one or preferably both following relationships are verified:

$PP_{1,2}=a_{1,2}^{2,4}\times PP_{2,4}+b_{1,2}^{2,4}$ and/or $PP_{1,3}=a_{1,3}^{2,4}\times PP_{2,4}$, wherein $PP_{1,2}$ always corresponds to the distance between the characteristic point $P_1$ and $P_2$, $PP_{1,3}$ always corresponds to the distance between the characteristic points $P_1$ and $P_3$, and $PP_{2,4}$ always corresponds to the distance between the characteristic points $P_2$ and $P_4$ (therefore a distance associated with the width of the face), and $a_{1,2}^{2,4}$, $a_{1,3}^{2,4}$, and $b_{1,2}^{2,4}$, are predefined real numbers constant to within a tolerance of 5%, preferably 3%, regardless of the size of the swimming masks.

The same type of investigations as the ones mentioned above for swimming goggles was in fact conducted for swimming masks and also showed that with a tolerance of 5%, preferably 3%, the series of swimming masks retains its properties for maximum coverage of the different morphotypes of the targeted population. In other words, $a_{1,2}^{2,4}$, $a_{1,3}^{2,4}$ and $b_{1,2}^{2,4}$, are constant to within 5%, preferably to within 3%, regardless of the size of these swimming masks.

Specifically, in this alternative described with reference to FIG. 2, regardless of the size of the swimming goggles, the values of the coefficients are the following to within 5%, preferably to within 3%: $a_{1,2}^{2,4}=0.07287$ and/or $a_{1,3}^{2,4}=0.3723$, and/or $b_{1,2}^{2,4}=-32.1$.

Preferably but not necessarily, these three coefficients $a_{1,2}^{2,4}$, $a_{1,3}^{2,4}$ and $b_{1,2}^{2,4}$, are modified with the respective values above (within a tolerance of 5%, possibly 3%).

The swimming masks may further be characterized with the following additional characteristic points:

- $P_5$: corresponds to the point at the intersection of the upper portion of the outer edge 6 of the left contact area 3 with the axis passing through the point $P_1$ and perpendicular to the segment $[P_2; P_4]$,
- $P_6$: corresponds to the point at the intersection of the upper portion of the outer edge 8 of the right contact area 2 with the axis passing through the point $P_3$ and perpendicular to the segment $[P_2; P_4]$,
- $P_7$: corresponds to the point at the intersection of the axis of symmetry A with the lower outer edge 13 of the median contact area 12,
- $P_8$: corresponds to the point in the middle of the lower edge 11 of the bridge 9, projected on the median contact layer 12,
- $P_9$: corresponds to the point in the middle of the upper edge 10 of the bridge 9, projected on the median contact area 12,
- $P_{10}$: corresponds to the point at the intersection of the axis of symmetry A with the upper outer edge 14 of the median contact area 12.

Thus, also in this series, certain additional dimensional parameters are related to other dimensional parameters, always through constant arithmetic relationships regardless of the size, i.e. arithmetic relationships independent of the size.

Thus, independently of the size, one or more of the following relationships are verified: $PP_{2,5}=a_{2,5}^{2,4}\times PP_{2,4}$, and/or $PP_{6,9}=a_{6,9}^{1,5}\times PP_{1,5}$ and/or $PP_{1,7}=a_{1,7}^{1,5}\times PP_{1,5}$, and/or $PP_{8,9}=a_{8,9}^{2,4}\times PP_{2,4}+b_{8,9}^{2,4}$, and/or $PP_{7,8}=a_{7,8}^{2,4}\times PP_{2,4}+b_{7,8}^{2,4}$, and/or $PP_{5,8}=a_{5,8}^{1,5}\times PP_{1,5}+b_{5,8}^{1,5}$, and/or $PP_{1,8}=a_{1,8}^{5,5}\times PP_{1,5}+b_{1,8}^{1,5}$, and/or $PP_{9,10}=a_{9,10}^{1,5}\times PP_{1,5}+b_{9,10}^{1,5}$.

In the same way as previously, the dimensional parameters $PP_{i,j}$ correspond to the distance between $P_i$ and $P_j$, for any i and j. Also $a_{2,5}^{2,4}$, $a_{6,9}^{1,5}$, $a_{1,7}^{1,5}$, $a_{8,9}^{2,4}$, $a_{7,8}^{2,4}$, $b_{7,8}^{2,4}$, $a_{5,8}^{1,5}$, $b_{5,8}^{1,5}$, $a_{1,8}^{1,5}$, $b_{1,8}^{1,5}$, $a_{9,10}^{1,5}$, and $b_{9,10}^{1,5}$, are predefined real numbers constant to within a certain tolerance, regardless of the size of the goggles.

A tolerance of 5%, preferably 3%, gives a series of swimming masks which retain their properties of maximum coverage of the different morphotypes of the targeted population. The aforementioned additional coefficients are therefore constant to within 5%, preferably to within 3%, regardless of the size of the masks.

Specifically, regardless of the size of these swimming masks, the values of these additional coefficients are the following, to within 5%, preferably to within 3%: $a_{2,5}^{2,4}=0.4365$, and/or $a_{6,9}^{1,5}=0.4938$, and/or $a_{1,7}^{1,5}=0.5777$, and/or $a_{8,9}^{2,4}=0.2000$, and/or $b_{8,9}^{2,4}=-10$, and/or $a_{7,8}^{2,4}=0.1333$, and/or $b_{7,8}^{2,4}=5.9$, and/or $a_{5,8}^{1,5}=0.3792$, and/or $b_{5,8}^{1,5}=16.5$, and/or $a_{1,8}^{1,5}=0.7050$, and/or $b_{1,8}^{1,5}=-1$, and/or $a_{9,10}^{1,5}=0.4073$, and/or $b_{9,10}^{1,5}=-8.2$.

Preferably, but not necessarily, all these additional coefficients and no longer only some of them, are modified with the respective values above (with a tolerance of 5%, possibly 3%).

Finally, FIG. 3 schematically illustrates an article of a series of the invention in a third alternative, wherein the article is more specifically of the diving mask type.

The mask thus comprises two optical elements, as this is already the case for the swimming goggles or mask described earlier: a right optical element 1 and a left optical element 3. Each optical element comprises a sealing element and an optical portion, strictly speaking, generally in translucent plastic material.

In the same way as for the swimming goggles or mask, the right optical element 1 comprises an optical portion, generally in plastic material, which may be broken up into a main optical portion 20 and a side optical portion 21. The right optical element 1 also comprises, as mentioned above, a right sealing element for example in silicone, which may assume the shape of a skirt, and which itself includes a contact area 2 via which this right sealing element will come into contact with the face of a person and possibly a side portion (not shown) via which this right sealing element joins the side optical portion 21.

Also, the left optical element 3 comprises an actual optical portion, generally in plastic material, which may be broken down into a main optical portion 22 and a side optical portion 23. The left optical element 3 also comprises a left sealing element, for example in silicone, possibly as a skirt, and which itself includes a left contact area 4 via which this left sealing element will come into contact with the face of a person and possibly a side portion (not shown) via which this left sealing element joins the side optical portion 23.

The right contact area of the optical element 1 comprises an inner edge 7 and an outer edge 8. Also, the left contact area 4 of the left sealing element of the left optical element 3 comprises an inner edge 5 and an outer edge 6.

The right optical element 1 and the left optical element 3 are symmetrical with respect to an axis of symmetry A.

In this alternative, the respective right and left contact areas 2, 4 join together on either side of this axis of symmetry A in a median contact area 12. The median contact area 12 then has an imprint for the nose 15 and is broken down into a lower portion and an upper portion.

The upper portion of this median contact area 12 has an inner edge 16 and an outer edge 17. The lower portion of this middle contact area 12 has an outer edge 18 and an inner edge 19.

The diving mask is thereby illustrated with its right and left optical elements 1 and 3, placed down flat on a same supporting plane with their optical portions 20 and 22, i.e. on their sides opposite to the sides of the right and left contact areas, 2 and 4, of the right and left sealing elements.

Moreover, the diving mask has the same main characteristic points as those mentioned with reference to the goggles and to the swimming mask (FIGS. 1 and 2), and the position of which is schematized in FIG. 3:

- $P_1$: corresponds to the lowest point of the outer edge 6 of the left contact area 4,
- $P_2$: corresponds to the leftmost point of the outer edge 6 of the left contact area 4, $P_3$: corresponds to the lowest point of the outer edge 8 of the right contact area 2, $P_4$: corresponds to the riqhtmost point of the outer edge 8 of the right contact area 2.

In the same way as in the case of the swimming goggles or mask, the points $P_1$ and $P_3$ are therefore symmetrical with respect to the axis A, and points $P_2$ and $P_4$ are also symmetrical with respect to this axis A.

All the diving masks of the series, regardless of their sizes, therefore of their dimensions, thus have the characteristic points mentioned above.

As for the swimming goggles or mask, the cutting out into several sizes and the accurate definition of these sizes, derive from anthropological and statistical investigations and tests, and are defined so as to provide maximum coverage rate of the population.

In this series, in a characteristic and fundamental way, and independently of the size, one or preferably both following relationships are further verified:

$PP_{1,2}=a_{1,2}^{2,4}\times PP_{2,4}+b_{1,2}^{2,4}$ and/or $PP_{1,3}=a_{1,3}^{2,4}\times PP_{2,4}$, wherein $PP_{1,2}$ always corresponds to the distance between the characteristic points $P_1$ and $P_2$, $PP_{1,3}$ always corresponds to the distance between the characteristic points $P_1$ and $P_3$, and $PP_{2,4}$ always corresponds to the distance between the characteristic points $P_2$ and $P_4$ (therefore a distance associated with the width of the face), and $a_{1,2}^{2,4}$, $a_{1,3}^{2,4}$, and $b_{1,2}^{2,4}$, are constant predefined real numbers within a tolerance of 5%, preferably 3%, regardless of the size of the diving masks.

The same type of investigations as those mentioned above for the swimming goggles or masks was actually conducted for diving masks and also showed that with a tolerance of 5%, preferably 3%, the series of diving masks retains its properties for maximum coverage of the different morphotypes of the targeted population. In other words, $a_{1,2}^{2,4}$, $a_{1,3}^{2,4}$, and $b_{1,2}^{2,4}$ are constant to within 5%, preferably to within 3%, regardless of the size of these diving masks.

Specifically, in this alternative described with reference to FIG. 3, regardless of the size of the diving masks, the values of the coefficients are the following to within 5%, preferably to within 3%: $a_{1,2}^{2,4}=0.5931$, and/or $a_{1,3}^{2,4}=0.5694$, and/or $b_{1,2}^{2,4}=0$.

Preferably, but not necessarily, these three coefficients $a_{1,2}^{2,4}$, $a_{1,3}^{2,4}$, and $b_{1,2}^{2,4}$ are modified with the respective values above (within the tolerance of 5%, possibly 3%).

The diving masks may further be characterized with the following additional characteristic points:

$P_9$: corresponds to the point at the intersection of the axis of symmetry A with the top of the contour of the imprint for the nose 15, $P_5$: corresponds to the point located on the left side of the contour of the imprint for the nose 15, at 4 cm from the point $P_9$.

$P_6$: corresponds to the point at the intersection of the upper portion of the outer edge 6 of the left contact area 4 with the axis passing through the point $P_1$ and perpendicular to the segment $[P_2; P_4]$, $P_7$: corresponds to the point located on the right side of the contour of the imprint for the nose 15, at 4 cm from the point $P_9$, $P_8$: corresponds to the deepest point of the imprint for the nose 15, $P_{10}$: corresponds to the point at the intersection of the axis of symmetry A with the inner edge 16 of the upper portion of the median contact area 12, $P_{11}$: corresponds to the point at the intersection of the axis of symmetry A with the outer edge 17 of the upper portion of the median contact area 12, $P_{12}$: corresponds to the point at the intersection of the axis of symmetry A with the outer edge 18 of the lower portion of the median contact area 12, $P_{13}$: corresponds to the point at the intersection of the axis of symmetry A with the inner edge 19 of the lower portion of the median contact area 12.

The point $P_{14}$ illustrated in FIG. 3, symmetrical to the point $P_6$ with respect to the axis of symmetry A, is also characteristic of the diving mask, but however not useful for the dimensional characterization of this mask.

Here again, therefore, certain additional dimensional parameters are related to other dimensional parameters, always by constant arithmetic relationships regardless of the size, i.e. arithmetic relationships independent of the size.

Thus, independent of size, one or more of the following relationships are verified: $PP_{2,9}=a_{2,9}^{2,4}\times PP_{2,4}$, and/or $PP_{1,13}=a_{1,13}^{5,7}\times PP_{5,7}$, and/or $PP_{5,9}=b_{5,9}$, and/or $PP_{8,9}=a_{8,9}^{1,6}\times PP_{1,6}$, and/or $PP_{9,13}=a_{9,13}^{1,6}\times PP_{1,6}$, and/or $PP_{8,13}=a_{8,13}^{1,6}\times PP_{1,6}+a_{8,13}^{2,4}\times PP_{2,4}+a_{8,13}^{5,7}\times PP_{5,7}+b_{8,13}$, and/or $PP_{12,13}=a_{12,13}^{1,6}\times PP_{1,6}+a_{12,13}^{2,4}\times PP_{2,4}+a_{12,13}^{5,7}\times PP_{5,7}+b_{12,13}$, and/or $PP_{9,12}=a_{9,12}^{1,6}\times PP_{1,6}+b_{9,12}^{1,6}$, and/or $PP_{1,9}=a_{1,9}^{1,6}\times PP_{1,6}+b_{1,9}^{1,6}$, and/or $PP_{6,9}=a_{6,9}^{2,4}\times PP_{2,4}+b_{6,9}^{2,4}$, and/or $PP_{11,13}=a_{11,13}^{1,6}\times PP_{1,6}+b_{11,13}^{1,6}$, and/or $PP_{10,13}=a_{10,13}^{1,6}\times PP_{1,6}+b_{10,13}^{1,6}$.

In the same way as previously, the dimensional parameters $PP_{i,j}$ correspond to the distance between $P_i$ and $P_j$, for any i and j. Also, $a_{1,13}^{5,7}$, $b_{5,9}$, $a_{8,9}^{1,6}$, $a_{9,13}^{1,6}$, $a_{8,13}^{1,6}$, $a_{8,13}^{2,4}$, $a_{8,13}^{5,7}$, $b_{8,13}$, $a_{12,13}^{1,6}$, $a_{12,13}^{2,4}$, $a_{12,13}^{5,7}$, $b_{12,13}$, $a_{9,12}^{1,6}$, $b_{9,12}^{1,6}$, $a_{1,9}^{1,6}$, $b_{1,9}^{1,6}$, $a_{6,9}^{2,4}$, $b_{6,9}^{2,4}$, $a_{11,13}^{1,6}$, $b_{11,13}^{1,6}$, $a_{10,13}^{1,6}$, and $b_{10,13}^{1,6}$, are predefined real numbers constant to within a certain tolerance, regardless of the size of the goggles.

Once more in this case, a tolerance of 5%, preferably 3%, gives a series of diving masks which retain its properties for maximum coverage of the different morphotypes of the targeted population. The aforementioned additional coefficients are therefore constant to within 5%, preferably to within 3%, regardless of the size of these masks.

Specifically, regardless of the size of the these diving masks, the values of the additional coefficients are the following, within 5%, preferably within 3%: $a_{2,9}^{2,4}=0.6926$, and/or $a_{1,13}^{5,7}=0.2085$, and/or $b_{5,9}=40$, and/or $a_{8,9}^{1,6}=0.5690$, and/or as $a_{9,13}^{1,6}=0.5534$, and/or $a_{8,13}^{1,6}=0.1770$, and/or $a_{8,13}^{2,4}=0.2005$, and/or $a_{8,13}^{5,7}=-0.3169$, and/or $b_{8,13}=-4.6$, and/or $a_{12,13}^{1,6}=0.0487$ and/or $a_{12,13}^{2,4}=0.0552$, and/or $a_{12,13}^{5,7}=-0.0872$, and/or $b_{12,13}=-1.3$, and/or $a_{9,12}^{1,6}=0.5796$, and/or $b_{9,12}^{1,6}=4.4$, and/or $a_{1,9}^{1,6}=0.5480$, and/or $b_{1,9}^{1,6}=24.6$; and/or $a_{6,9}^{2,4}=0.4813$, and/or $b_{6,9}^{2,4}=-1.5$, and/or $a_{11,13}^{1,6}=0.8781$, and/or $b_{11,13}^{1,6}=6.4$, and/or $a_{10,13}^{1,6}=0.7316$, and/or $b_{10,13}^{1,6}=10.3$.

Preferably, but not necessarily, all these additional coefficients and no longer only some of them, are modified with the respective values above (with a tolerance of 5%, possibly 3%).

The whole of the description above is of course given as an example and is not a limitation of the invention.

In particular, the exact shape and geometry of the different articles of underwater vision of the series described above is not limiting to the invention, from the moment that these articles have the main characteristic points as described, with the constant arithmetic relationships) as also described, independently of the size of the article.

The invention claimed is:

1. A series of underwater vision articles, comprising several articles of different sizes, said articles including a right optical element itself including a right sealing element intended to come into contact via its right contact area with the face of a person, and a left optical element itself including a left sealing element intended to come into contact via its left contact area with the face of a person, wherein when said right and left article elements are placed down flat on a same supporting plane on their side opposite to the side of said right and left contact areas of said right and left sealing elements the following points are present:

$P^1$ being the lowest point of the inner or outer edge of said left contact area, $P_2$ being the leftmost point of the inner or outer edge of said left contact area, $P_3$ being the lowest point of the inner or outer edge of said right contact area, $P_4$ being the rightmost point of the inner or outer edge of the right contact area, wherein regardless the size of said articles in the series, at least one of the ratio between $PP_{2,4}$ and $PP_{1,3}$ is constant to within 5%, and the ratio between $PP_{2,4}$ plus a constant predefined to within 5%, and $PP_{1,2}$ is constant to within 5%, wherein $PP_{i,j}$ is the distance between $P_i$ and $P_j$, for any i and j.

2. The series of underwater vision articles according to claim 1, wherein said articles are swimming goggles, wherein regardless of the size of said articles at least one of, the ratio between $PP_{2,4}$ and $PP_{1,3}$ is equal to 1.7428 to within 5%, and the ratio between $PP_{2,4}$ and $PP_{1,2}$ is equal to 3.4722 to within 5%.

3. The series of underwater vision articles according to claim 1, wherein said articles are swimming goggles and further comprise the following points:

$P_5$ being the rightmost point of the inner edge of said left contact area, $P_6$ being the point at the intersection of the upper portion of the inner edge of said left contact area with the axis passing through said point $P_1$ and perpendicular to the segment $P_2$; $P_4$, $p_7$ being the leftmost point of the inner edge of said right contact area, $P_8$ being the point in the middle of the upper edge of the bridge connecting the right optical element to said left optical element, $P_9$ being the point in the middle of the lower edge of the bridge, wherein the series, regardless of the size of the articles further comprises at least one of $PP_{1,5}=a_{1,5}^{1,6}\times PP_{1,6}$, $PP_{2,6}=a_{2,6}^{2,4}\times PP_{2,4}+b_{2,6}^{2,4}$, $PP_{5,6}=a_{5,6}^{1,6}\times PP_{1,6}+b_{1,6}^{5,6}$, $PP_{5,8}=a_{5,8}^{5,7}\times PP_{5,7}+b_{5,8}^{5,7}$, and $PP_{8,9}=b_{8,9}$, wherein $PP_{ij}$ is the distance between $P_i$ and $P_j$, for any i and j, and $a_{1,5}^{1,6}$, $a_{2,6}^{2,4}$, $b_{2,6}^{2,4}$, $a_{5,6}^{1,6}$, $b_{1,6}^{5,6}$, $a_{5,8}^{5,7}$, $b_{5,8}^{5,7}$ and $b_{8,9}$ are predefined real numbers constant to within 5%, regardless of the size of said articles.

4. The series of underwater vision articles according to claim 3, wherein at least one of $a_{1,5}^{1,6}=0.8745$, $a_{2,6}^{2,4}=0.2450$, $b_{2,6}^{2,4}=4.2$, $a_{5,6}^{1,6}=0.3088$, $a_{1,6}=15.7$, $a_{5,8}^{5,7}=0.3874$, $b_{5,8}^{5,7}=15.3$, and $b_{8,9}=10$, regardless of the size of said articles, these values being defined to within 5%.

5. The series of underwater vision articles according to claim 1, wherein said articles are swimming masks, wherein regardless of the size of said articles, the ratio between at least one of $PP_{2,4}$ and $PP_{1,3}$ is equal to 2.6860 to within 5%, and $PP_{2,4}$ less the constant 44.0 defined to within 5%, and $PP_{1,2}$ is equal to 1.3723 to within 5%.

6. The series of underwater vision articles according to claim 1, said articles being swimming masks with an axis of symmetry (A) between said right and left optics, said right and left contact areas joining on either side of said axis of symmetry (A) in a median contact area, said right and left optical elements being connected through a bridge, said articles further comprising the following points:

$P_5$ being the point at the intersection of the upper portion of the outer edge of said left contact area with the axis passing through said point $P_1$ and perpendicular to the segment $[P_2; P_4]$, $P_6$ being the point at the intersection of the upper portion of the outer edge of said right contact area with the axis passing through said point $P_3$ and perpendicular to the segment $[P_2; P_4]$, $P_7$ being the point at the intersection of the axis of symmetry (A) with the lower outer edge of said median contact area, $P_8$ being the point in the middle of the lower edge of said bridge projected on said median contact area, $P_9$ being the point in the middle of the upper edge of said bridge projected on said median contact area, $P_{10}$ being the point at the intersection of said axis of symmetry (A) with the upper outer edge of said median contact area, wherein said series is further comprises at least one of, regardless of the size of said articles:

$PP_{2,5}=a_{2,5}^{2,4}\times PP_{2,4}$, $PP_{6,9}=a_{6,9}^{1,5}\times PP_{1,5}$, $PP_{1,7}=a_{1,7}^{1,5}\times PP_{1,5}$, $PP_{8,9}=a_{8,9}^{2,4}\times PP_{2,4}+b_{8,9}^{2,4}$, $PP_{7,8}=a_{1,7}^{2,4}\times PP_{2,4}+b_{7,8}^{2,4}$, $PP_{5,8}=a_{5,8}^{1,5}\times PP_{1,5}+b_{5,8}^{1,5}$, $PP_{1,8}=a_{1,8}^{1,5}\times P_{1,5}+b_{1,8}^{1,5}$, and $PP_{9,10}=a_{9,10}^{1,5}\times PP_{1,5}+b_{9,10}^{1,5}$, wherein $PP_{i,j}$ is the distance between $P_i$ and $P_j$ for any i and j and $a_{2,5}^{2,4}$, $a_{6,9}^{1,5}$, $a_{1,7}^{1,5}$, $a_{8,9}^{2,4}$, $b_{8,9}^{2,4}$, $a_{7,8}^{2,4}$, $b_{7,8}^{2,4}$, $a_{5,8}^{1,5}$, $b_{5,8}^{1,5}$, $a_{1,8}^{1,5}$, $b_{1,9}^{1,5}$, $a_{9,10}^{1,5}$ and $b_{9,10}^{1,5}$ are predefined real numbers constant to within 5%, regardless of the size of said articles.

7. The series of underwater vision articles according to claim 6, further comprising at least one of $a_{2,5}^{2,4}=0.4365$, $a_{6,9}^{1,5}=0.4938$, $a_{1,7}^{1,5}=0.5777$, $a_{8,9}^{2,4}=0.2000$, $b_{8,9}^{2,4}=-10$, $a_{7,8}^{2,4}=0.1333$, $b_{7,8}^{2,4}=5.9$, $a_{5,8}^{1,5}=0.3792$ $b_{5,8}^{1,5}=16.5$, $a_{1,8}^{1,5}=0.7050$, $b_{1,8}^{1,5}=-1$, $a_{9,10}^{1,5}=0.4073$, and $b_{9,10}^{1,5}=-8.2$, regardless of the size of said articles, these values being defined to within 5%.

8. The series of underwater vision articles according to claim 1, wherein said articles are diving masks, wherein regardless of the size of said articles, the articles have at least one of the ratio between $PP_{2,4}$ and $PP_{1,3}$ is equal to 1.7562 to within 5%, and the ratio between $PP_{2,4}$ and $PP_{1,2}$ is equal to 1.6861 to within 5%.

9. The series of underwater vision articles according to claim 1, wherein said articles are diving masks with an axis of symmetry (A) between said right and left optics, said right and left contact areas joining on either side of said axis of symmetry (A) in a median contact area, said median contact area having an imprint of the nose, wherein said articles further comprise the following points:

$P_9$ being the point at the intersection of said axis of symmetry (A) with the top of the contour of said imprint for the nose, $P_5$ being the point located on the left side of the contour of said imprint for the nose, at 4 cm from point $P_9$, $P_6$ being the point at the intersection of the upper portion of the outer edge of said left contact area with the axis passing through said point $P_1$ and perpendicular to the segment $[P_2; P_4]$, $P_7$ being the point located on the right side of the contour of said imprint for the nose, at 4 cm from point $P_9$, $P_8$: the deepest point of said imprint for the nose, $P_{10}$ being the point at the intersection of said axis of symmetry (A) with the inner edge of the upper portion of said median contact area, $P_{11}$ being the point at the intersection of said axis of symmetry (A) with the outer edge of the upper portion of said median contact area, $P_{12}$ being the point at the intersection of said axis of symmetry (A) with the outer edge of the lower portion of said median contact area, $P_{13}$ being the point at the intersection of said axis of symmetry (A) with the inner edge of the lower portion of said median contact area, wherein said series, regardless of the size of said articles having at least one of $PP_{2,9}=a_{2,9}^{2,4}\times PP_{2,4}$, $PP_{1,13}=a_{1,13}^{5,7}\times PP_{5,7}$, $PP_{5,9}=b_{5,9}$ and/or $PP_{8,9}^{1,6}\times PP_{1,6}$, $PP_{9,13}=a_{9,13}^{1,6}\times PP_{1,6}$, $PP_{8,13}=a_{8,13}^{1,6}\times PP_{1,6}+a_{8,13}^{2,4}\times PP_{2,4}+a_{8,13}^{5,7}\times PP_{5,7}+b_{8,13}$, $PP_{12,13}=a_{12,13}^{1,6}\times PP_{1,6}+a\ a_{12,13}^{2,4}\times PP_{2,4}+a_{12,13}^{5,7}$33 $PP_{5,7}+b_{12,13}$, $PP_{9,12}=a_{9,12}^{1,6}\times PP_{1,6}+b_{9,12}^{1,6}$, $PP_{1,9}=a_{1,9}^{1,6}\times PP_{1,6}+b_{1,9}^{1,6}$, $PP_{6,9}=a_{6,9}^{2,4}\times PP_{2,4}+b_{6,9}^{2,4}$, $PP_{11,13}=a_{11,13}^{1,6}\times PP_{1,6}+b_{11,13}^{1,6}$, and $PR_{10,13}=a_{10,13}^{1,6}\times PP_{1,6}+b_{10,13}^{1,6}$, wherein $PP_{i,j}$ is the distance between $P_i$ and $P_j$ for any i and j, and $a_{2,9}^{2,4}$, $a_{1,13}^{5,7}$, $b_{5,9}$, $a_{8,9}^{1,6}$, $a_{9,13}^{1,6}$, $a_{8,13}^{1,6}$, $a_{8,13}^{2,4}$, $a_{8,13}^{5,7}$, $b_{8,13}$, $a_{12,13}^{1,6}$, $a_{12,13}^{1,6}$, $a_{12,13}^{5,7}$, $b_{12,13}$, $a_{9,12}$, $b_{9,12}^{1,6}$, $a_{1,9}^{1,6}$, $b_{1,9}^{1,6}$, $a_{6,9}^{2,4}$, $b_{6,9}^{2,4}$, $a_{11,13}^{1,6}$, $b_{11,13}^{1,6}$, $a_{10,13}$ and $b_{10,13}^{1,6}$, are predefined real numbers constant to within 5% regardless of the size of said articles.

10. The series of underwater vision articles according to claim 9, further having at least one of $a_{2,9}^{2,4}=0.6926$, $a_{1,13}^{5,7}=1.2085$, $b_{5,9}=40$, $a_{8,9}^{1,6}=0.5690$, $a_{9,13}^{1,6}=0.5534$, $a_{8,13}^{1,6}=0.1770$, $a_{8,13}^{2,4}=0.2005$, $a_{8,13}=-4.6$, $a_{12,13}^{1,6}=0.0487$, $a_{12,13}^{2,4}=0.0552$ $a_{12,13}^{5,7}=-0.0872$ $b_{12,13}=-1.3$, $a_{9,12}^{1,6}=0.5796$, $b_{9,12}^{1,6}=4.4$, $a_{1,9}^{1,6}=0.5480$, $b_{1,9}^{1,6}=24.6$, $a_{6,9}^{2,4}=0.4813$, $b_{6,9}^{2,4}=-1.5$, $a_{12,13}^{1,6}=0.8781$, $b_{11,13}^{1,6}=6.4$, $a_{10,13}^{1,6}=0.7316$, and $b_{10,13}^{1,6}=10.3$, regardless of the size of the articles, these values being defined to within 5%.

* * * * *